United States Patent [19]

Stadler

[11] Patent Number: 4,482,069

[45] Date of Patent: Nov. 13, 1984

[54] CAP CLOSURE INCLUDING PIERCEABLE SEALING ELEMENT

[75] Inventor: Reinhard Stadler, Karlsruhe, Fed. Rep. of Germany

[73] Assignee: Gesepa Anstalt Für Patentverwertung, Vaduz, Liechtenstein

[21] Appl. No.: 461,974

[22] Filed: Jan. 26, 1983

[30] Foreign Application Priority Data

Jan. 30, 1982 [DE] Fed. Rep. of Germany ..... 3203176
Apr. 5, 1982 [DE] Fed. Rep. of Germany ..... 3212685
Oct. 23, 1982 [DE] Fed. Rep. of Germany ..... 3239302

[51] Int. Cl.[3] ..... B65D 39/00
[52] U.S. Cl. ..... 215/249
[58] Field of Search ..... 215/247, 248, 249; 604/415

[56] References Cited

U.S. PATENT DOCUMENTS 3,760,969 9/1973 Shimamoto et al. ..... 215/247
4,366,912 1/1983 Matukura et al. ..... 215/247

FOREIGN PATENT DOCUMENTS 1465326 2/1977 United Kingdom .
1602090 11/1981 United Kingdom .

*Primary Examiner*—Donald F. Norton
*Attorney, Agent, or Firm*—Wenderoth, Lind & Ponack

[57] ABSTRACT

A cap closure for pharmaceutical containers includes a perforatable stopper-shaped or disk-shaped sealing element covered by a closing cap and is provided for sealing engagement with the container neck. The sealing element is formed as two parts, one consisting of an open supporting part and the other an elastic filling part which is produced by injecting plastic material into the supporting part, the elastic filling part being connected firmly to the supporting part and forming a seal in relation to the container neck.

22 Claims, 6 Drawing Figures

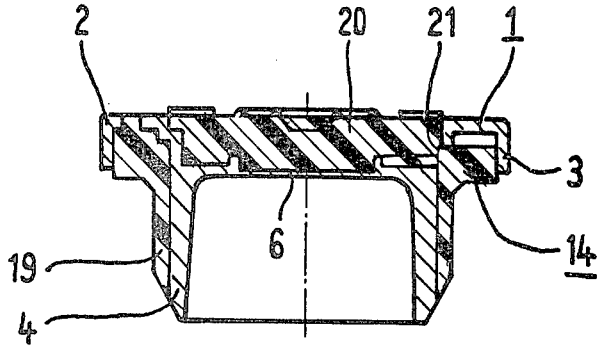
FIG. 3
FIG. 4
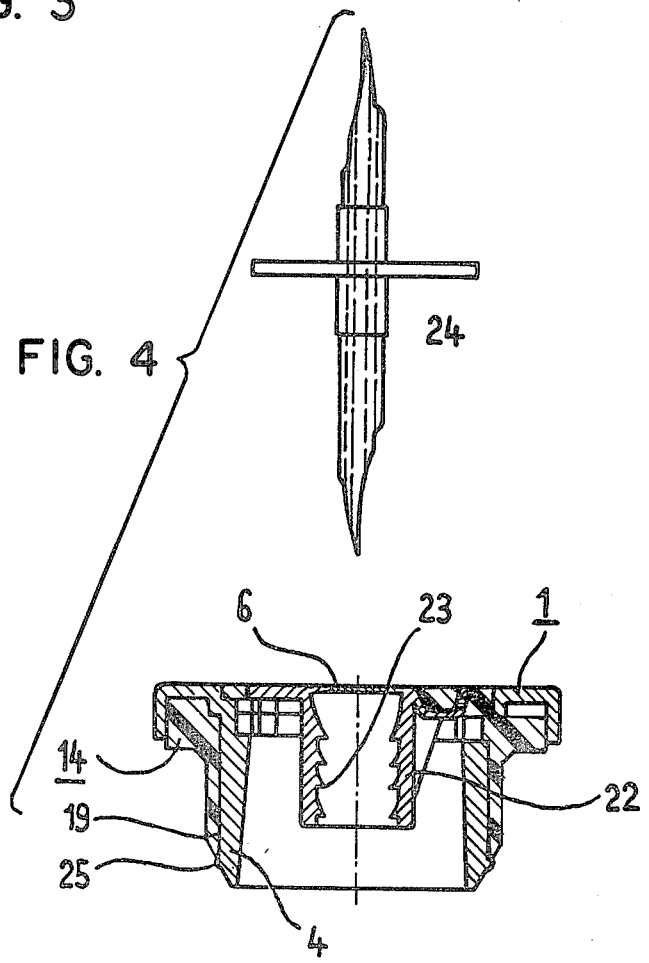

CAP CLOSURE INCLUDING PIERCEABLE SEALING ELEMENT

BACKGROUND OF THE INVENTION

The invention relates to cap closures for pharmaceutical containers, especially for bottles containing substances intended for infusion, transfusion or injection, in which, for sealing, there is on the container neck a pierceable stopper-shaped or disk-shaped sealing element which is covered by a closing cap. A process for producing the sealing element used is also indicated.

Cap closures for pharmacuetical containers, using metal flanged caps or welded plastic caps, are known, for example, from German Offenlegungsschrift No. 2,727,737 and from German Patent Specification No. 2,327,553. In these, the bottle neck is sealed off by means of a pierceable disk-shaped or stopper-shaped elastic sealing element which is covered by a closing cap which is completely detachable or is detachable at the central region. In the case of metal flanged caps, this closing cap is fastened to the bottle neck by means of flanging on edge bead and, in the case of plastic caps, the cap is fastened to the neck of the plastic bottle as a result of welding by means of a flanged edge.

The stopper-shaped or disk-shaped sealing elements used for preclosing the bottle are solid and made of rubber or of a plastic with appropriate elastomeric properties. This solid design means a considerable waste of the relatively costly elastomeric rubber material. Moreover, there is a danger that during the storage period rubber constituents, especially plasticizer substances, will penetrate into the container contents, mix therewith and in so doing contaminate it. Moreover, during stamping of the solid rubber stoppers, stamping fragments which adhere firmly are obtained, and these can easily be introduced into the container. Furthermore, when the rubber stopper is perforated by means of a transfusion or injection needle, particles detached by the needle point can be introduced into the container contents and may be carried out together with the container contents.

SUMMARY OF THE INVENTION

The invention starts from the proposed object of designing a cap closure of the type defined in the introduction, in such a way that the stopper-shaped or disk-shaped sealing element largely avoids the above-described disadvantages of the known solid rubber design. Rubber constituents will not migrate substantially during the storage period, nor will the container contents mix with particles arising during closing or during piercing. Furthermore, the cap closure with the novel sealing element will permit simple, economical and largely automated mass production in the manufacture and closure of the containers.

An important feature of the invention is that the sealing element has an open supporting part and an elastic filling part which is produced by being injected into the supporting part and is connected firmly, preferably unreleasably, to the supporting part and which forms a seal in relation to the container neck. An especially advantageous development appears to be one in which there is provided in the supporting part an integral perforatable membrane part.

Because of the firm connection of a relatively, dimensionally stable supporting part forming a supporting skeleton for an elastic filling part injected into it, sufficient dimensional rigidity and sealing effect can be achieved with an economical use of material. At the same time, the surfaces of the elastic filling part which communicate with the container interior can be kept relatively small.

The perforatable membrane part, provided if appropriate, which is integral with the supporting part, especially in its central region, prevents particles of the filling part, which are detached by the needle point during perforation, from being introduced into the container contents and subsequently from being conveyed out together with the container contents.

The elastic layer which the filling part can form on the membrane part retains infusion and injection needles firmly as a result of its clamping effect. During the penetration of the relatively thin-walled membrane part (thickness preferably less than 0.5 mm), there arises a stripping effect which keeps away from the container contents particles and the like which are detached from the filling part.

In another appropriate embodiment, a retaining device which is leak-proof at the edge for receiving a piercing part can be located on the membrane part. In this case, there is no need for a layer of the filling part on the membrane part. The piercing part, which can be designed in a known way in the form of a spear or even as a cannula, is then retained, for example, by a tubular extension with sealing lips projecting from the inner wall of the membrane part.

In an appropriate design of the sealing element in stopper form, the supporting part can have an upper cover part with a flanged edge which is connected integrally to a cylindrical insertion part. In this case, passage recesses for injecting the filling part are advantageously provided between the upper cover part of the supporting part and the hollow-cylindrical insertion part. The filling part forms in the cover part a central bearing layer which overlays the membrane part and which extends over the passage recesses from the inner cavity of the flanged edge into the region of the outer side of the cylindrical insertion part and there forms a seal against the inner wall of the container neck.

So that the bearing of the filling part on the outer side of the cylindrical insertion part is limited perfectly, it is appropriate to limit the spread of filling material during the injection-molding operation along the surface of the cylindrical insertion part by means of an integral edge strip.

In the design with a disk-shaped sealing element, it may be advantageous if the supporting part is a disk with a projecting edge, in the center of which an insertion part is located, and if the filling part consists of a portion in the form of an annular disk and of a cylindrical center piece which is connected to this via passage recesses and which rests as a bearing layer on the membrane part.

To make it easier to feed the disk-shaped sealing element automatically during mechanical closure of the containers, it may also be appropriate for the edge of the supporting part to be designed geometrically in such a way that it is possible to orientate the sealing element in a specific position. For this purpose, the edge of the supporting part can either be made conical or can be provided with other orientation projections. It is thereby possible to orientate the sealing elements fed from a supply container, in such a way that when being applied the elastic sealing surface points towards the container edge. Because the portion, in the form of an annular disk, of the filling part is, if desirable, appropriately covered with an elastic covering membrane, it is possible to produce a disk-shaped sealing element which has facing towards the container interior only the surfaces of the filling part which are absolutely necessary for sealing off.

In a design in which the filling part forms a layer on the membrane part, it may be appropriate to attach on this membrane part an annular outer reinforcing strip which surrounds an annular inner reinforcing strip likewise attached on the membrane part. At the same time, preformed on the surface of the bearing layer of the filling part are piercing guide recesses for the annular and circular surfaces on the membrane part formed by the reinforcing strips. These guide recesses make it possible to attach a transfusion needle or an additional injection needle in the desired direction.

An additional practical advantage when the sealing element designed as a closing stopper is pulled out can be achieved, if appropriate, by shaping a pull-off element integrally on the supporting part. Appropriately, the pull-off element can be made annular in design, i.e. a pull-off ring, its height corresponding essentially to the thickness of the cover part enclosed by the pull-off ring. At the same time, the pull-off ring forms, in practice, the outermost edge of the cover part and can be covered together with this, by the flanged cap.

Various pharmaceutically compatible plastics, especially polypropylene, are suitable as material for the essentially dimensionally stable, but not necessarily dimensionally rigid supporting part. Since the supporting part, as a dimensionally stable basic body, does not need to have any substantial elastic properties, it can be selected, above all, from the standpoint of a material which is closely compatible with the container contents. The elastic properties required are obtained by means of the elastic filling part. An injection-moldable rubber compound is especially suitable for this purpose.

An embodiment in which the proportion by weight of the supporting part is more than 25% of the filling part seems appropriate. As a result of this, a considerable reduction in costs is brought about, in addition to the favorable properties mentioned. The use of the expensive elastic filling material remains restricted to the regions in which elastic properties must be present for sealing-off edges or for the additional retention of piercing cannulae.

An appropriate process for producing a sealing element for a cap closure of the type described in the introduction can involve injection-molding the supporting part in a first operation and injecting the elastic filling part into the finished supporting part in a subsequent second operation. This produces a favorable work cycle and the desired firm anchoring of the filling part in the supporting part. Furthermore, a development of the production process which seems favorable is one in which the supporting part is molded in one mold recess of a displaceable or rotatable injection mold and in which the filling part is injected into the supporting part remaining in the mold recess after the transfer of the mold, whilst a supporting part is injection-molded in the other mold recess. This allows operation in a timed sequence and at a high working speed.

Applying the features of the invention provides a cap closure with a pierceable sealing element in stopper or disk form, which combines favorable sealing properties with high dimensional stability and substantial prevention of the penetration of undesirable constituents into the container contents. The novel sealing element, in which a supporting part is connected to an elastic filling part which remains largely screened off from the container interior, prevents the container contents from being damaged and permits economical manufacture as a mass-produced article.

Among the objects of the invention are, therefore, the provision of an improved cap closure and method of manufacturing the cap closure.

Other objects of the invention will become apparent from the following detailed description when taken in conjunction with the accompanying drawings in which like parts are designated by like reference numerals.

BRIEF DESCRIPTION OF THE DRAWINGS

FIG. 3 is a longitudinal section through a complete hollow stopper using an alternative design for the supporting part;

FIG. 4 is a longitudinal section through a complete hollow stopper with an aditional retaining device;

DETAILED DESCRIPTION OF THE PREFERRED EMBODIMENTS

Figure 1:
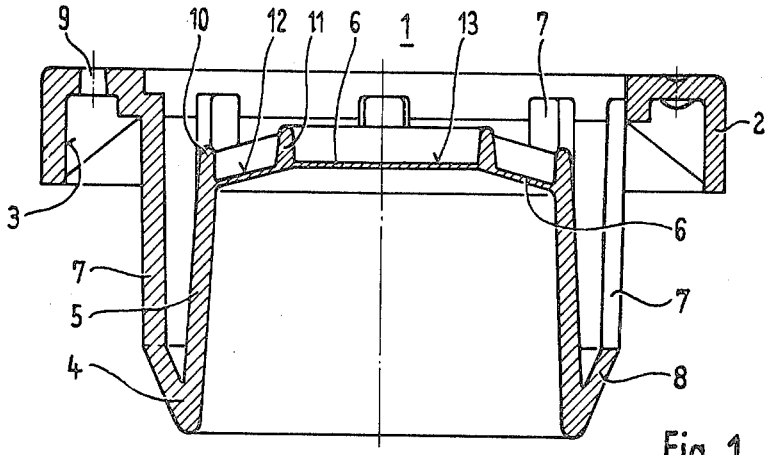
FIG. 1 is a longitudinal section through a supporting part for a sealing element in the form of a hollow stopper.
Figure 2:
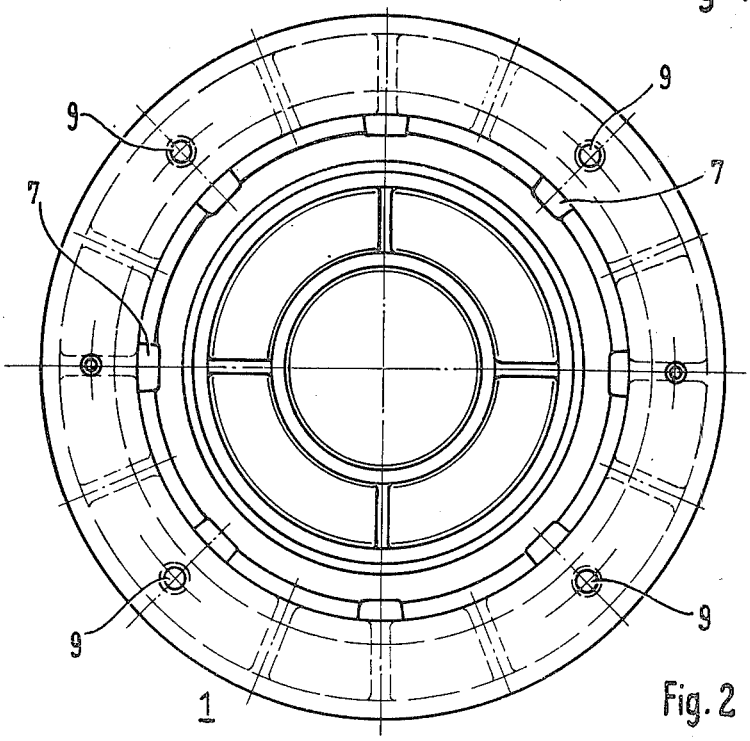
FIG. 2 is a plan view of the supporting part according to FIG. 1.

FIGS. 1 and 2 show a supporting part or member 1 of a sealing element which supporting part consists of an upper cover part or portion 2 with a flanged edge 3 open on the underside, and a pot-shaped, closing part or portion 5 forming part of a hollow-cylindrical insertion part or portion 4. A membrane part or portion 6 is shaped integrally in the bottom of the closing part 5. The connection between the pot-shaped closing part 5 and the cover part 2 is made via webs 7 connected integrally to both parts 2, 5. The lower edge of the pot-shaped closing part 5 is drawn up in a conical outer part or portion 8 up to a sealing-off surface formed when the closing stopper is complete.

Figure 5:
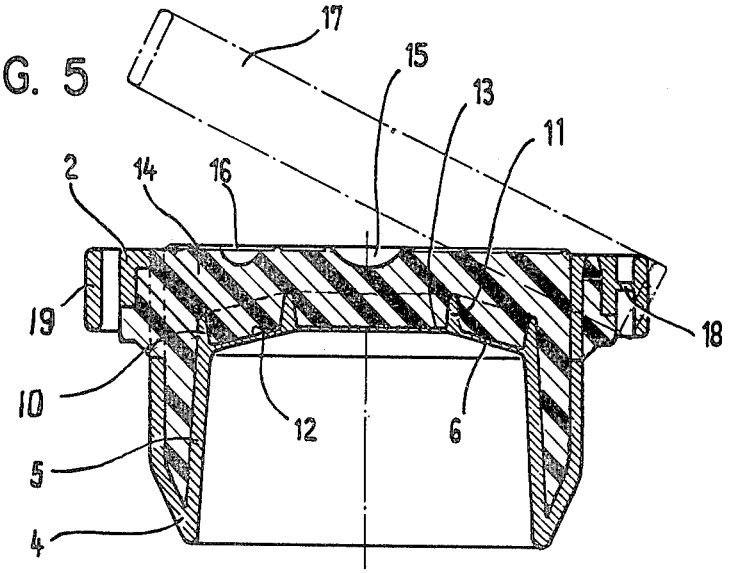
FIG. 5 is a longitudinal section through a complete hollow stopper with a pull-off ring.

The cover part 2 is provided with injection recesses 9 through which the material of the filling part can be injected and connected to the supporting part 1. The completed closing stopper corresponds in structure essentially to the arrangement shown in FIG. 5, but without ring 17, to be discussed below.

Arranged on the membrane part 6 are annular reinforcing strips 10, 11 which delimit on the membrane part 6 an outer annular perforation surface 12 and an inner circular perforation surface 13. Shaped in the filling part or member 14 (see FIG. 5) are guide recesses 15, 16. These serve for guiding an infusion needle into the inner circular perforation surface 13 and for guiding an injection needle into the outer annular perforation surface 12 of the membrane part 6 and consequently for adding additional substances to the container contents. To pull the closing stopper out of the bottle neck, in a design according to FIG. 5 a pull-off ring 17 is connected integrally to the cover part 2 via a connecting web 18. The position of the pull-off ring 17 shown by dot-and-dash lines corresponds to the position of use.

The height of the pull-off ring 17 matches the thickness of the cover part 2.

In the embodiment according to FIG. 3, the filling part 14 is formed with an annular portion or bearing layer 19 on the outside of the hollow-cylindrical insertion part 4. The connection between another portion or bearing layer 20 of the filling part 14 resting on the membrane part 6 and the bearing layer 19 is made via passages 21.

FIG. 4 shows a supporting part 1 corresponding to FIG. 3, but in which the membrane part 6 is not covered by a bearing layer of the filling part 14. On the contrary, in the edge region of the membrane part 6 there is a tubular retaining device 22 with sealing lips 23 which firmly clamp, with edge sealing, a piercing member or cannula 24 after the membrane part 6 has been severed.

The bearing layer 19 of the filling part 14 is limited in the edge region of the hollow-cylindrical insertion part 4 by an edge strip 25 formed integrally with part 4.

Figure 6:
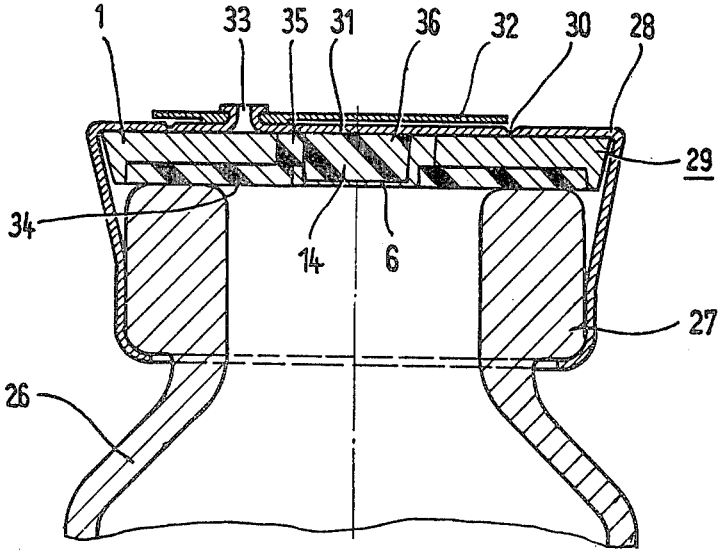
FIG. 6 is a longitudinal section through a cap closure with a disk-shaped sealing element.

A complete cap closure is illustrated in the embodiment according to FIG. 6. It shows the neck of a bottle-shaped container 26, the edge bead 27 of which is covered by a metal flanged cap 28, with a disk-shaped sealing element 29 interposed. Located in the cover surface of the flanged cap 28 made leak-proof metallically is a prepared tearing line 30, along which a central part 31 in the form of a circular disk can be pulled out by means of a pull-off ring 32. The pull-off ring 32 is connected to a hollow rivet 33 shaped integrally from the material of the flanged cap.

The disk-shaped sealing element 29 consists of the supporting part 1 and the elastomeric filling part 14. The filling part 14 is composed of a portion 34 in the form of an annular disk and of a cylindrical central piece or portion 36 connected to this via passage recesses 35. This central piece 36 forms a bearing layer on the membrane part 6.

A sealing element consisting of an open supporting part and of a filling part produced by injection into the supporting part and thereby connected firmly to the supporting part has been described above as part of a cap closure. However, the stopper-shaped design of the sealing element, with or without a pull-off element attached to the cover edge, can, if desired, also be used by itself, that is to say without a closing cap engaging over it, for the closing of containers. In this case, the closing cap engaging over the container can, if appropriate, also advantageously be replaced by an open closing strip, a covering foil or the like.

It is believed that the foregoing description fully describes the structure and operation of the invention. Certain changes may be made in the above described sealing element and method of manufacture thereof without departing from the scope of the invention. It is intended that all matter contained in the description or shown in the accompanying drawings shall be interpreted as illustrative and not in a limiting sense.

What I claim as my invention is:

1. In a cap closure for a pharmaceutical container having a neck, said cap closure being of the type including a pierceable sealing element for sealing the container neck, and a closing cap covering said sealing element and engageable with the container neck, the improvement wherein said sealing element comprises:

a supporting member having a first side, a second side and at least one passage extending through said supporting member from said first side thereof to said second side thereof, said supporting member forming a skeleton of said sealing element; and an elastic filling member injection molded and rigidly fixed to said supporting member, said filling member including a first portion on said first side of said supporting member, a second portion on said second side of said supporting member, and a connecting portion integral with said first and second portions and extending through said passage in said supporting member, said second portion of said filling member having an annular configuration and defining a seal adapted to seal the container neck.

2. The improvement claimed in claim 1, wherein said supporting member includes a pierceable membrane.

3. The improvement claimed in claim 2, wherein said first portion of said filling member comprises a layer covering said membrane.

4. The improvement claimed in claim 3, wherein said membrane has extending therefrom into said layer radially inner and outer concentric reinforcing ribs, thereby defining an inner round membrane portion and an outer annular membrane portion.

5. The improvement claimed in claim 4, wherein said layer has formed therein, in a surface thereof opposite said ribs, recesses aligned with said inner and outer membrane portions.

6. The improvement claimed in claim 2, wherein said supporting member further includes an integral tubular element surrounding said membrane and extending from said second side thereof, said tubular element having an inner surface having sealing means for sealing against a piercing member adapted to pierce said membrane.

7. The improvement claimed in claim 2, wherein said supporting member comprises a disk having in said first side thereof a central recess defining said membrane and having in said second side thereof an annular recess surrounding said membrane.

8. The improvement claimed in claim 7, comprising plural said passages extending through said disk between said central recess and said annular recess.

9. The improvement claimed in claim 8, wherein said first portion of said filling member comprises a layer filling said central recess, said second portion of said filling member comprises an annular layer filling said annular recess, and said connecting portion comprises plural portions extending through said plural passages.

10. The improvement claimed in claim 1, wherein said supporting member includes a cover portion having a flanged outer edge, and a cylindrical insertion portion extending from said cover portion and integral therewith.

11. The improvement claimed in claim 10, comprising plural said passages extending through said supporting member between said cover portion and said cylindrical insertion portion.

12. The improvement claimed in claim 11, wherein said second portion of said filling member comprises an annular layer on the outer surface of said cylindrical insertion portion.

13. The improvement claimed in claim 10, wherein said supporting member further comprises an annular pull-off element formed integrally with and surrounding said cover portion.

14. The improvement claimed in claim 1, wherein said supporting member further includes an integral pull-off member.

15. The improvement claimed in claim 1, wherein said supporting member comprises an injection molded rigid plastic material, and said filling member comprises a rubber compound.

16. The improvement claimed in claim 15, wherein the weight of said supporting member is more than 25% of the weight of said filling member.

17. A closing stopper for a pharmaceutical container, said stopper comprising:

a supporting member having a first side, a second side and at least one passage extending through said supporting member from said first side thereof to said second side thereof, said supporting member forming a skeleton; and an elastic filling member injection molded and rigidly fixed to said supporting member, said filling member including a first portion on said first side of said supporting member, a second portion on said second side of said supporting member, and a connection portion integral with said first and second portions and extending through said passage in said supporting member, said second portion of said filling member having an annular configuration and defining a seal adapted to seal the container neck.

18. A stopper as claimed in claim 17, wherein said supporting member comprises injection molded rigid plastic material, and said filling member comprises a rubber compound.

19. A stopper as claimed in claim 18, wherein the weight of said supporting member is more than 25% of the weight of said filling member.

20. A stopper as claimed in claim 17, wherein said supporting member includes a pierceable membrane, said first portion of said filling member comprises a layer covering said membrane, said membrane has extending therefrom into said layer radially inner and outer concentric reinforcing ribs, thereby defining an inner round membrane portion and an outer annular membrane portion, and said layer has formed therein, in a surface thereof opposite said ribs, recesses aligned with said inner and outer membrane portions.

21. A stopper as claimed in claim 17, wherein said supporting member comprises a disk having in said first side thereof a central recess defining a pierceable membrane and having in said second side thereof an annular recess surrounding said membrane, and comprising plural said passages extending through said disk between said central recess and said annular recess.

22. A stopper as claimed in claim 17, wherein said supporting member includes a cover portion having a flanged outer edge and a cylindrical insertion portion extending from said cover portion and integral therewith, with plural said passages extending through said supporting member between said cover portion and said cylindrical insertion portion, and said supporting member further comprises an annular pull-off element formed integrally with and surrounding said cover portion.

* * * * *